US009267253B2

(12) United States Patent
Nakayasu et al.

(10) Patent No.: US 9,267,253 B2
(45) Date of Patent: Feb. 23, 2016

(54) LAND-MOUNTED FLAP GATE

(71) Applicant: HITACHI ZOSEN CORPORATION, Osaka-Shi, Osaka (JP)

(72) Inventors: Kyouichi Nakayasu, Osaka (JP); Yuuichiro Kimura, Osaka (JP); Ryouta Yoshiki, Osaka (JP); Toshiaki Morii, Osaka (JP)

(73) Assignee: HITACHI ZOSEN CORPORATION, Osaka-Shi, Osaka (JP)

( * ) Notice: Subject to any disclaimer, the term of this patent is extended or adjusted under 35 U.S.C. 154(b) by 0 days.

(21) Appl. No.: 14/660,944

(22) Filed: Mar. 18, 2015

(65) Prior Publication Data

US 2015/0299973 A1 Oct. 22, 2015

(30) Foreign Application Priority Data

Apr. 16, 2014 (JP) ..... 2014-084526

(51) Int. Cl.

| | |
|---|---|
| ***E02B 3/10*** | (2006.01) |
| ***E02B 3/16*** | (2006.01) |
| ***E02B 7/20*** | (2006.01) |
| ***E02B 7/54*** | (2006.01) |

(52) U.S. Cl.
CPC . *E02B 3/16* (2013.01); *E02B 3/102* (2013.01); *E02B 7/20* (2013.01); *E02B 7/54* (2013.01)

(58) Field of Classification Search
CPC ..... E02B 7/20; E02B 7/26; E02B 7/36; E02B 7/40; E02B 7/46; E02B 7/54; E02B 3/10; E02B 3/102; E02B 3/16
See application file for complete search history.

(56) References Cited

U.S. PATENT DOCUMENTS

| | | | | | |
|---|---|---|---|---|---|
| 2,617,263 | A * | 11/1952 | Hill | E02B 7/42 | 405/100 |
| 2,689,459 | A * | 9/1954 | Mayo, Sr. | E02B 7/205 | 405/101 |
| 2,701,953 | A * | 2/1955 | Travilla | E02B 7/46 | 405/102 |
| 2003/0024865 | A1* | 2/2003 | Kezele | E02B 7/205 | 210/170.1 |
| 2012/0219360 | A1* | 8/2012 | Morii | E02B 7/50 | 405/100 |

FOREIGN PATENT DOCUMENTS

| | | | | |
|---|---|---|---|---|
| DE | 19651389 | A1 * | 6/1998 | E02B 3/104 |
| GB | 207863 | A * | 12/1923 | E02B 7/20 |
| JP | 2012-241449 | A | 12/2012 | |
| WO | WO 2011065086 | A1 * | 6/2011 | E02B 7/44 |

* cited by examiner

*Primary Examiner* — Frederick L Lagman
(74) *Attorney, Agent, or Firm* — Yokoi & Co., U.S.A.; Toshiyuki Yokoi

(57) ABSTRACT

A land-mounted flap gate formed by arranging and connecting a plurality of door bodies alongside one another is disclosed. The front side of each of the plurality of door bodies is raised and lowered using the back end side of each door body as a support point. One end of a rope is attached to the back end surface of the door body and the other end of the rope is attached to a counter weight. At least one fixed pulley for guiding the rope is disposed below the back end side of the door body such that the counter weight assists the raising or lowering when starting the raising or lowering and acts as a resistance against the raising or lowering before completing the raising or lowering. The waterproof film that seals a space between neighboring door bodies in a waterproof manner is formed in a substantially trapezoidal shape.

3 Claims, 6 Drawing Sheets

PRIOR ART

LAND-MOUNTED FLAP GATE

CROSS-REFERENCES TO RELATED APPLICATIONS

This patent specification is based on Japanese patent application, No. 2014-084526 filed on Apr. 16, 2014 in the Japan Patent Office, the entire contents of which are incorporated by reference herein.

BACKGROUND OF THE INVENTION

1. Field of the Invention

The present invention relates to a land-mounted flap gate that is installed in a wide-span opening such as the top surface of the embankment of a seawall or the like as a countermeasure against, for example, high tides or tidal waves.

2. Description of Related Art

An example of a flap gate is a floating body-type flap gate that is installed in an opening of a seawall and that raises door bodies using the buoyancy of incoming water to block the opening in order to prevent water increased at the time of water increase from flowing into living spaces or underground spaces (see, e.g., Japanese Unexamined Patent Application Publication No. 2012-241449).

When such a floating body-type flap gate is installed on the top surface of the embankment of a seawall, a required height is achieved only in case of emergency and the height of the embankment can be kept low in a normal situation, so that a view can be unobstructed from a land side to a sea side, and thus the landscape is not spoiled by the flap gate.

However, in the case of this floating body-type flap gate that is installed on the top surface of the embankment of a seawall, the length of a part for blocking the inflow of sea water becomes longer when compared with the floating body-type flap gate that is installed in the opening of a seawall, so that the number of door bodies connected with each other increases and the number of connections between the door bodies also increases. Furthermore, it is difficult to generate sufficient auxiliary force to the operation of raising or lowering door bodies with only both sides of the floating body-type flap gate.

As illustrated in FIG. 8, this connection between neighboring door bodies is performed by bonding flanges 2 along the whole side surfaces of neighboring door bodies 1 by means of welding, superimposing a waterproof rubber 3 and a pressing plate 4 on the upper surface of each of the flanges 2, and inserting a waterproof film 5 which connects the door bodies 1 in a watertight manner between the waterproof rubber 3 and pressing plate 4 of these neighboring door bodies 1, and then fastening bolts 6 and nuts 7 at predetermined intervals.

However, the floating body-type flap gate regularly requires a floating inspection on the start of raising and an operation inspection from a lowered state to a raised state and from a raised state to a lowered state, as well as a visual appearance inspection.

When the floating inspection on the start of raising or the operation inspection between the lowered state and the raised state is performed, it is difficult to inspect all door bodies at one time because the floating body-type flap gate that is installed on the top surface of the embankment of a seawall has a large number of door bodies connected to each other.

In particular, the floating inspection on the start of raising is performed after all the connections between neighboring door bodies have been released in order not to influence other neighboring door bodies. In this case, it is very cumbersome to unfasten a plurality of bolts and nuts that secure waterproof films that connect the neighboring door bodies to each other in a watertight manner.

BRIEF SUMMARY OF THE INVENTION

Problems that the present invention attempts to solve reside in that, in the case where a floating body-type flap gate is installed on the top surface of the embankment of a seawall or the like, when a floating body-type flap gate is introduced as flooding prevention means for a long-span opening, a scheme for generating sufficient auxiliary force to the operations of door bodies using only both sides of the floating body-type flap gate imposes limitations on the width of a gate to be installed in terms of structure and also it is very cumbersome to perform a floating inspection on the start of raising.

Objects of the present invention are to enable installation regardless of span length by installing a mechanism for generating auxiliary force to the operation of door bodies below each of the door bodies, and to reduce the burden of maintenance and repair because it is not necessary to remove waterproof films fastened between neighboring door bodies when a floating inspection on the start of raising or an operation inspection between a lowered state and a raised state is performed.

In the present invention, there is provided a land-mounted flap gate formed by arranging and connecting a plurality of door bodies alongside one another, the front side of each of the plurality of door bodies being raised and lowered using the back end side of each door body as a support point, wherein one end of a rope is attached to the back end surface of the door body and the other end of the rope is attached to a counter weight, and at least one fixed pulley for guiding the rope is disposed below the back end side of the door body such that the counter weight reaches its lowest point in the middle of raising or lowering of the door body, assists the raising or lowering when starting the raising or lowering, and acts as a resistance against the raising or lowering before completing the raising or lowering; and wherein a waterproof film that seals a space between neighboring door bodies in a waterproof manner is formed in a substantially trapezoidal shape whose width extends gradually from the back end side of the door body to the front end side thereof.

In the present invention, using a certain point in the middle of raising or lowering of the door body as a turning point, the counter weight assists the raising or lowering when starting the raising or lowering, and acts as a resistance against the raising or lowering before completing the raising or lowering. Accordingly, conformity to the water level can be improved when starting the raising or lowering, and also the impact of the raising or lowering can be mitigated before completing the raising or lowering.

Furthermore, in the present invention, the waterproof film that seals a space between neighboring door bodies in a waterproof manner is formed in a substantially trapezoidal shape whose width extends gradually from the back end side of the door body to the front end side thereof, so that the front end side of the door body can be raised within a predetermined angle independently of neighboring door bodies.

Accordingly, the floating inspection on the start of raising can be performed merely by hanging a floating inspection weight on the back end surface of a target door body.

Moreover, the operation inspection between a lowered state and a raised state can be performed merely by hanging an operation inspection movable pulley on the back end surface of each of the door bodies and winding the rope wound around both the movable pulley and the operation inspection fixed pulley installed below the back end side of the door body by means of the winch.

BRIEF DESCRIPTION OF THE DRAWINGS

The above and other objects, features and advantages of the present invention will be more clearly understood from the following detailed description and accompanying drawings, in which:

FIGS. 1A-1D illustrate views of the schematic configuration of a land-mounted flap gate according to an embodiment of the present invention, wherein FIG. 1A is a plan view of door bodies in a lowered state, FIG. 1B is a side view of the door bodies in the lowered state, FIG. 1C is a front view of the door bodies in the lowered state, and FIG. 1D is a back view of the door bodies in the lowered state;

FIGS. 2A-2C illustrate views of a waterproof configuration between neighboring door bodies of a land-mounted flap gate according to an embodiment of the present invention, wherein FIG. 2A is a side view of the waterproof configuration between neighboring door bodies in a lowered state, FIG. 2B is a perspective view of the waterproof configuration between the neighboring door bodies in the lowered state when viewed from a front side of the door bodies, and FIG. 2C is a plan view of a waterproof film;

FIGS. 3A-3C illustrate perspective views of states, in which one or more floating inspection weights have been hung in order to perform a floating inspection on the start of raising in a land-mounted flap gate according to an embodiment of the present invention, when viewed from the back end side of a door body, wherein FIG. 3A is a view of the case where a single floating inspection weight is hung at a single location of the back end of each door body, FIG. 3B is a view of the case where two floating inspection weights are hung at two locations of the back end of each door body, respectively, and FIG. 3C is a view of the case where two floating inspection weights are hung at a single location of the back end surface of each door body;

FIGS. 5A and 5B illustrate views of a situation in which an operation inspection between a lowered state and a raised state is performed in a land-mounted flap gate according to an embodiment of the present invention, wherein FIG. 5A is a view of the situation when viewed from a side of door bodies in a lowered state, and FIG. 5B is a view of the situation when viewed from the back end side of the door bodies in a lowered state;

FIGS. 6A and 6B illustrate views of another arrangement example in which a fixed pulley guides a rope to which a counter weight has been attached in a land-mounted flap gate according to an embodiment of the present invention, wherein FIG. 6A is a view of the arrangement example when viewed from a side of door bodies in a lowered state, and FIG. 6B is a view of the arrangement example when viewed from the back end side of the door bodies in a lowered state;

FIGS. 7A and 7B illustrate views of the case where a drum is used instead of the fixed pulley of the embodiment illustrated in FIGS. 6A and 6B, wherein FIG. 7A is a view of the case when viewed from a side of door bodies in a lowered state, and FIG. 7B is a view of the case when viewed from the back end side of the door bodies in a lowered state.

DETAILED DESCRIPTION OF THE INVENTION

The present invention achieves the object of the present invention, i.e., to enable installation regardless of the span length and eliminate a need for the removal of waterproof films sealing spaces between neighboring door bodies in a waterproof manner when a floating inspection on the start of raising or an operation inspection between a lowered state and a raised state is performed by installing a mechanism for assisting the operation of each door body below the door body and forming the waterproof films in a substantially trapezoidal shape whose width extends gradually from the back end side of the door bodies to the front end side thereof.

Embodiment

Hereinafter, an embodiment for carrying out the present invention is explained in detail with reference to FIGS. 1 to 5.

FIGS. 1A-1D illustrate views of the schematic configuration of a land-mounted flap gate according to an embodiment of the present invention.

Figure 1A:
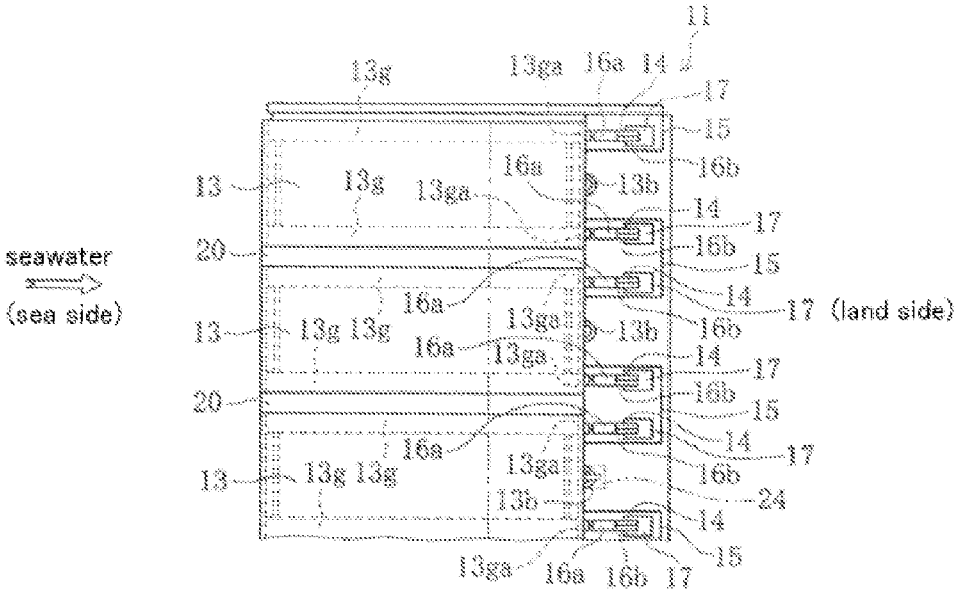
Figure 1B:
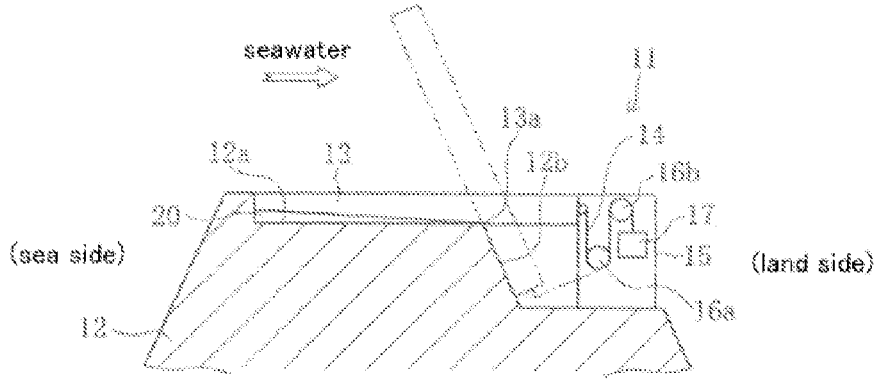

In FIGS. 1A-1D, reference numeral 11 denotes the land-mounted flap gate of the present embodiment installed on the top surface 12*a* of the embankment of a seawall 12. The land-mounted flap gate 11 is raised by sea water flowing over the seawall 12 when high tides or tidal waves occur, and then prevents sea water from flowing from the seawall 12 into a land side. In FIGS. 1A and 1B, a left side falls under a sea side and a right side falls under a land side.

The land-mounted flap gate 11 is formed by arranging and connecting a plurality of door bodies 13 alongside one another, as illustrated in FIG. 1A. As illustrated by imaginary lines (dotted lines) in FIG. 1B, the front side of the land-mounted flap gate 11 located on the sea side is raised and lowered using the back side of the land-mounted flap gate 11, located on the land side, as a support point 13*a* falling under a fulcrum.

One end of a rope 14 is attached to, for example, two points of the back end surface of each of the door bodies 13, and the other end (a remaining end) of the rope 14 is attached to a counter weight 17 via, for example, two fixed pulleys 16*a* and 16*b*. The fixed pulleys 16*a* and 16*b* are disposed in the land-side inner space of the back end of a post 15 which is installed on the land side of the back end of the door body 13 and whose ceiling surface has approximately the same height as the top surface of the door body 13 in a lowered state.

The fixed pulleys 16*a* and 16*b* are disposed at certain locations in order that the counter weight 17 can reach its lowest point in the middle of raising or lowering of the door body 13, assist the raising or lowering when starting the raising or lowering, and act as a resistance against the raising or lowering before completing the raising or lowering.

The land-mounted flap gate 11 according to the present embodiment, which is configured as described above, does not spoil the landscape when the door bodies 13 are in the lowered state because there are no components of the land-mounted flap gate 11 which are disposed above the door bodies 13.

Meanwhile, when incoming sea water on the occurrence of high tides or tidal waves flows over the seawall 12 into the land side, the door bodies 13 are raised by buoyancy generated due to the incoming sea water acting on the door bodies 13, without the supply of power or the manipulation of humans. When the raising starts, the counter weights 17 are lowered and thus assist the door bodies 13 to be raised.

The door bodies 13 are raised in response to an increase in water level. During the raising of the door bodies 13, the counter weights 17 have reached their lowest location and then are raised. Accordingly, the counter weights 17 act as resistances reducing the raising speed of the door bodies 13. As a result, impact that occurs when the raising is terminated is mitigated.

Furthermore, when a water level is lowered due to the dissipation of high tides or tidal waves, the counter weights 17 are also lowered and thus pull the door bodies 13 in a direction in which the door bodies 13 will be lowered, so that the door bodies 13 are lowered in accordance with a decrease in water level. During the lowering of the door bodies 13, the counter weights 17 have reached their lowest location and then are raised to act as a resistance reducing the lowering speed of the door bodies 13. As a result, impact that occurs when the lowering of the door bodies 13 is terminated is mitigated.

Furthermore, in the land-mounted flap gate 11 according to the present embodiment, which is configured by arranging and connecting the plurality of door bodies 13 alongside one another, neighboring door bodies 13 are connected to each other in a waterproof state.

Figure 2A:
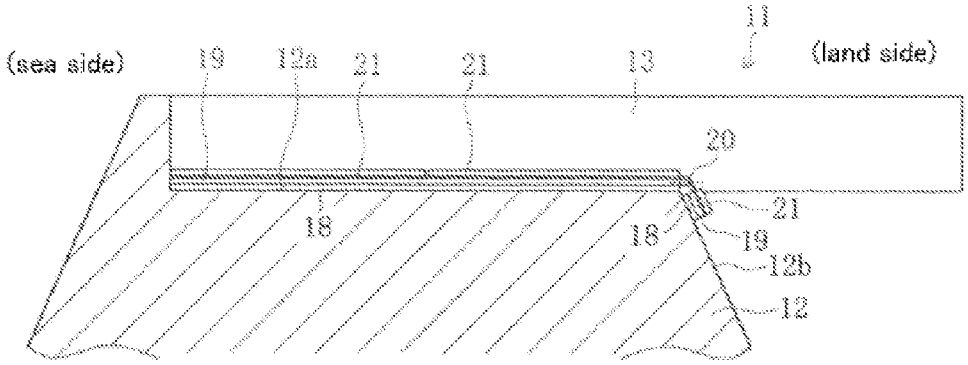
Figure 2B:
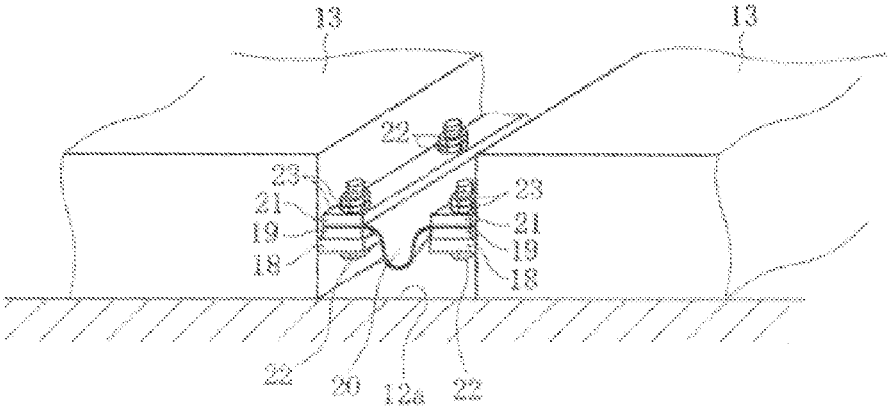
Figure 2C:
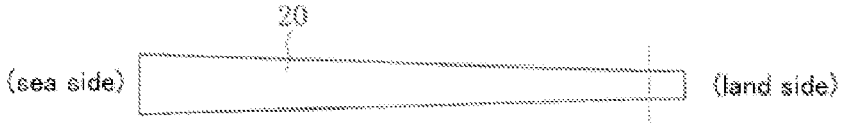
Figure 3A:
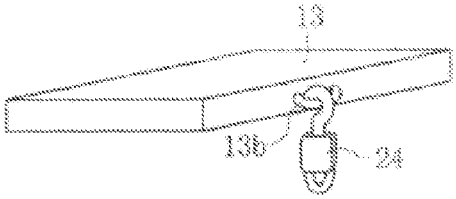
Figure 3B:
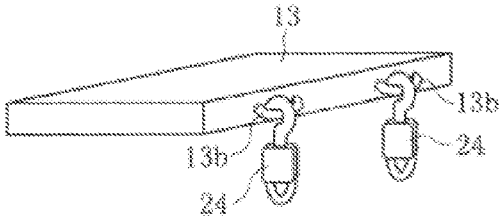
Figure 3C:
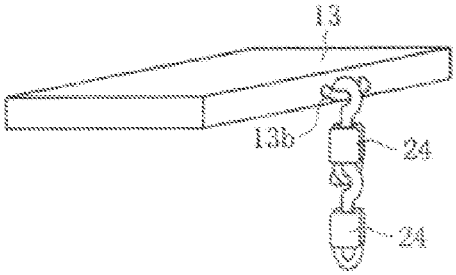

This connection is performed on the top surface 12*a* of the embankment of the seawall 12 and on an upper face of the land-side normal surface 12*b* of the embankment at locations where neighboring door bodies 13 face each other, as illustrated in FIGS. 2A and 2B. That connection is implemented by bonding flanges 18 onto the neighboring side surfaces and bottom surfaces of neighboring door bodies 13 by means of welding, disposing a waterproof film 20 on the upper surfaces of the flanges 18 with waterproof rubber 19 interposed therebetween, and then firmly pressing the flanges 18, the waterproof rubber 19 and the waterproof film 20 with pressing plates 21 made of steel and fastening them with bolts 22 and nuts 23. Furthermore, in the present invention, a trapezoidal waterproof film whose width extends gradually from the back end side of the door bodies 13 to the front end side thereof, as illustrated in FIG. 2C, is used as the waterproof film 20 that seals the space between the neighboring door bodies 13 in a waterproof manner.

Since the waterproof film 20 that seals the space between the neighboring door bodies 13 in a waterproof manner is formed in a substantially trapezoidal shape whose width extends gradually from the back end side of the door bodies 13 to the front end side thereof as described above, the front end side of each of the door bodies 13 can be raised within a predetermined angle, e.g., an angle of about 3 degrees, independently of its neighboring door bodies 13.

Figure 1C:
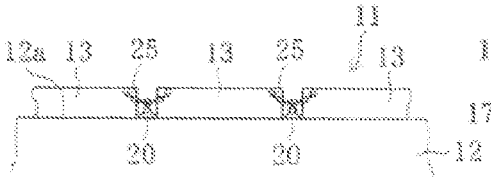
Figure 1D:
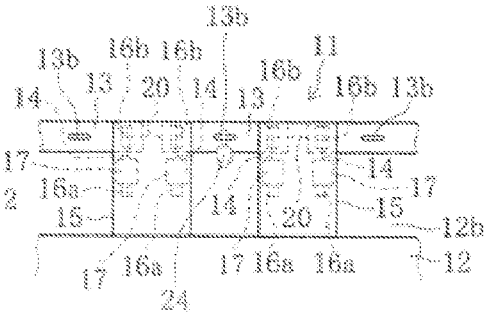

Accordingly, a floating inspection on the start of raising can be performed merely by hanging a floating inspection weight 24 on a hanging member 13*b* disposed on the back end of a target door body 13, as illustrated in FIG. 1D, without releasing the connection between the neighboring door bodies 13. Furthermore, it is preferable that this floating inspection weight 24 has a weight ranging from about 10 kg to about 20 kg so that humans can easily handle the floating inspection weight 24.

In the floating inspection on the start of raising, as long as the front end side of the door body 13 can be raised within an angle of, e.g., about 3 degrees, a single floating inspection weight 24 (see FIG. 3A) or two floating inspection weights 24 (see FIG. 3C) may be hung at a single location of the door body 13. Furthermore, two floating inspection weights 24 may be hung at two locations of the door body 13, respectively (see FIG. 3B).

In order to prevent the case where the front end side of a door body 13 is raised above, e.g., about 3 degrees independently of its neighboring door body 13 and thus force is exerted upon the waterproof film 20, it is preferable to loosely connect the front end surfaces of the neighboring door bodies 13, e.g., using a chain 25, as illustrated in FIG. 1C. A means for connecting the neighboring door bodies 13 is not limited to the chain 25, but any type of means may be used as long as the means can achieve the same operational effect as the chain 25.

Figure 4:
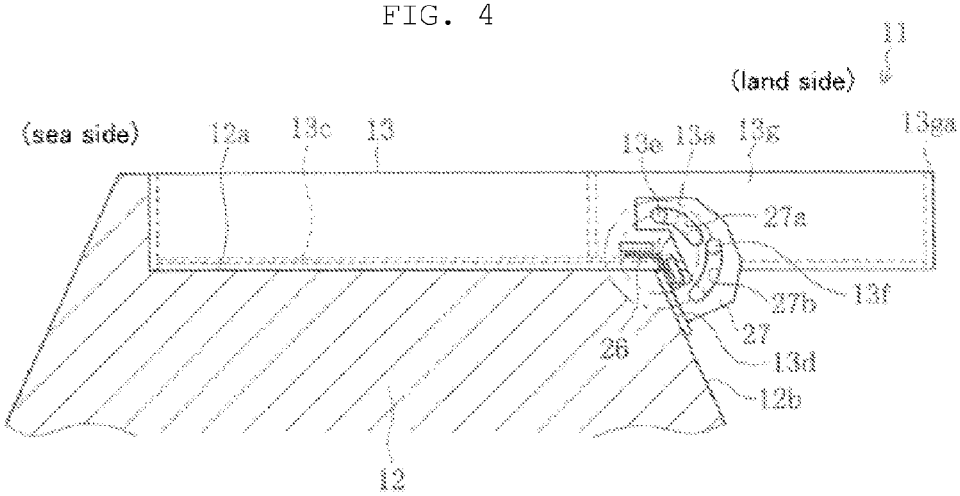
FIG. 4 is a view illustrating an example of a waterproof structure for the bottoms of door bodies and a support point structure for raising and lowering movements in a land-mounted flap gate according to an embodiment of the present invention when viewed from a side of the door bodies in a lowered state.

Meanwhile, the watertightness between the door bodies 13 and the land-side normal surface 12*b* is achieved by connecting a skin plate 13*c* of each of the door bodies 13 with a body-side waterproof member 13*d* by means of waterproof rubber 26, as illustrated in FIG. 4.

Two pins 13*e* and 13*f* are mounted, on both side surfaces of each of the plurality of door bodies 13 connected in the above-described structure, at locations on different radii around the support point 13*a*, as illustrated in FIG. 4. A guide member 27 in which two arcuate guide holes 27*a* and 27*b* having the same radii as the pins 13*e* and 13*f* are formed, is mounted on the land-side normal surface 12*b* of the seawall 12. When the door bodies 13 are lowered, the pins 13*e* and 13*f* are guided along the arcuate guide holes 27*a* and 27*b*. In this case, the arcuate lengths of the guide holes 27*a* and 27*b* are determined based on the angle of the raising and lowering of the front end sides of the door bodies 13.

If this structure is adopted, a rotating shaft is not required at the support point 13 for the raising and lowering of the door bodies 13, and thus the line of watertightness can be continued without interruption. Furthermore, a water pressure load exerted onto the door body 13 is supported by two points of the pins 13*e* and 13*f* and the end 13*ga* of a longitudinal girder 3*g* of the door body 13, and is then transferred to a body.

Figure 5A:
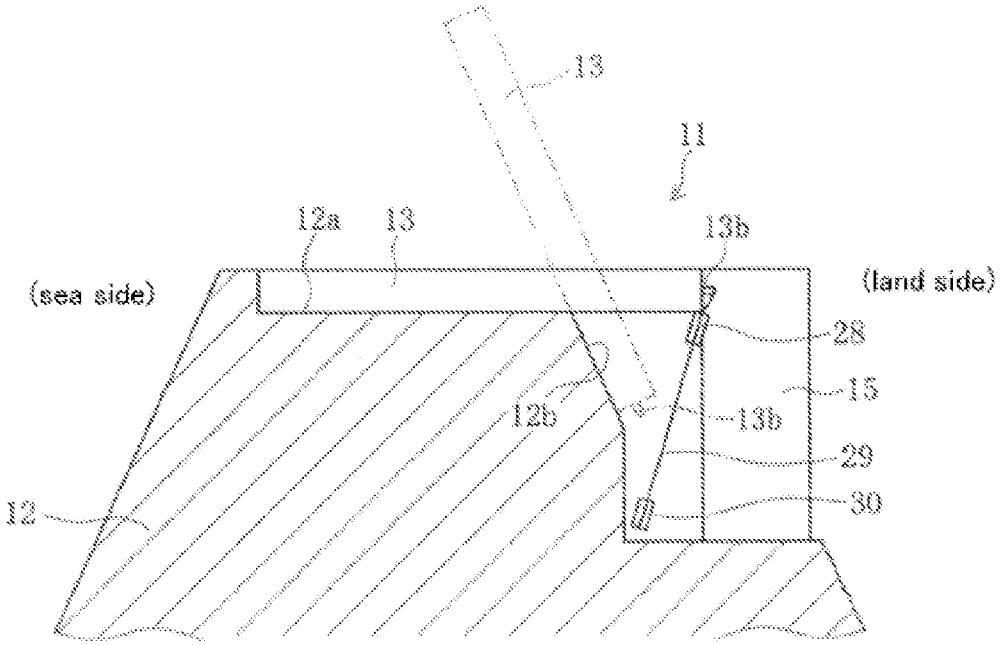
Figure 5B:
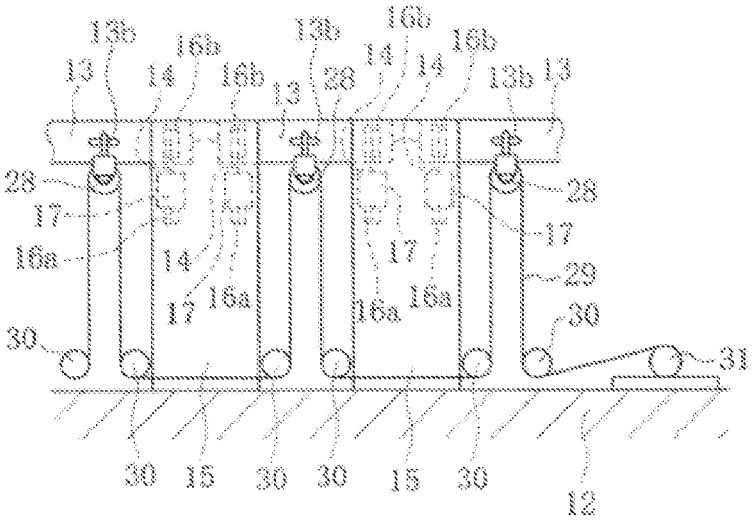

FIGS. 5A and 5B illustrate a mechanism for performing an operation inspection between a lowered state and a raised state. In this mechanism, operation inspection fixed pulleys 30 for guiding a rope 29 wound around operation inspection movable pulleys 28 hung on the hanging members 13*b* disposed on the back end of the door body 13, for example, and a winch 31 for winding the rope 29 are disposed below the back end side of the door bodies 13.

In this configuration, an operation inspection between the lowered state and the raised state may be performed by hanging the operation inspection movable pulleys 28 instead of the floating inspection weights 24 on the back ends of the door bodies 13 and by winding the rope 29 wound around both the movable pulleys 28 and the operation inspection fixed pulleys 30 using the winch 31, as illustrated in FIG. 5B.

It will be apparent that the present invention is not limited to the above embodiment but appropriate modifications and variations can be made to the embodiment within the scope of the technical ideas recited in claims.

Figure 6A:
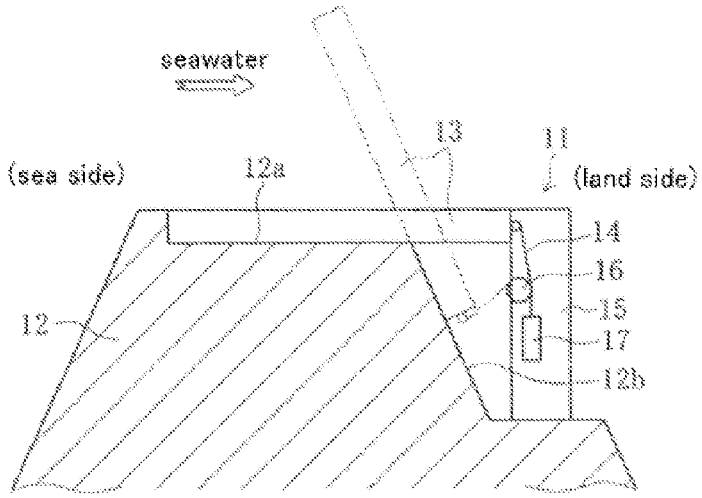
Figure 6B:
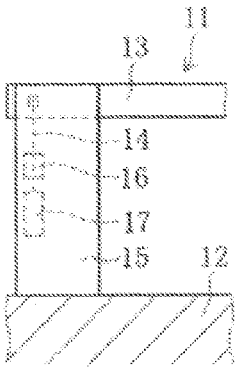
Figure 7A:
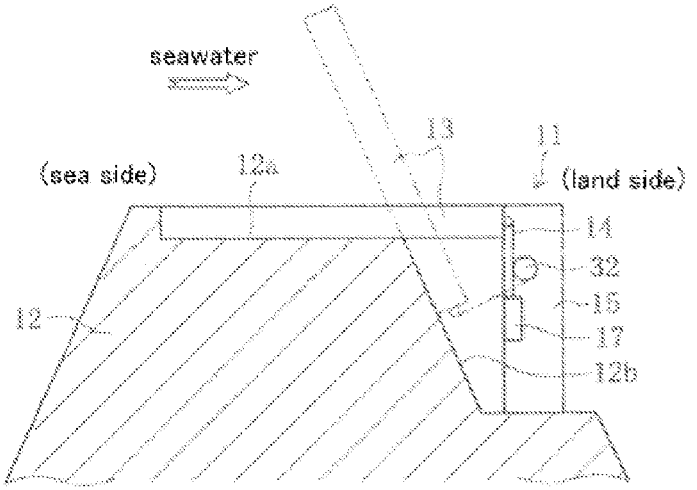
Figure 7B:
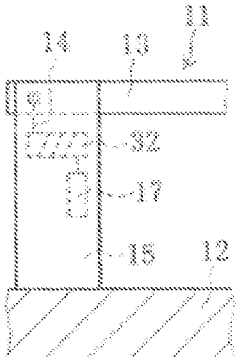
Figure 8:
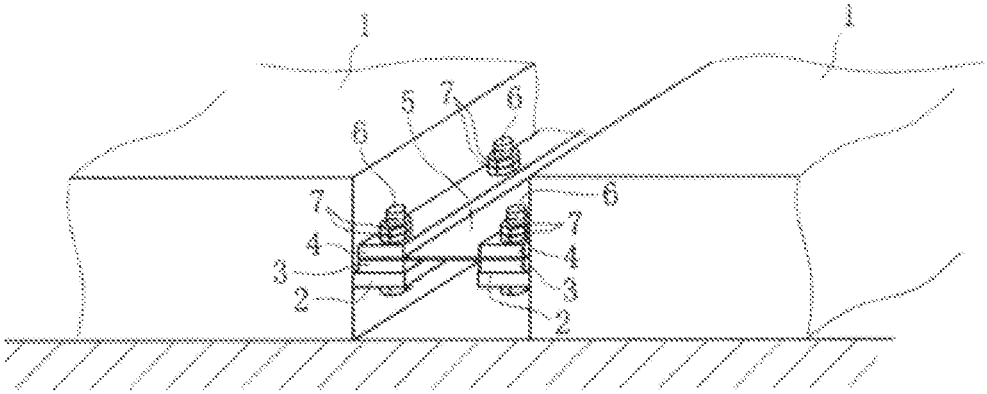
FIG. 8 illustrates a view of a waterproof configuration between neighboring door bodies of a conventional flap gate when viewed from the front end side of the door bodies.

For example, in the above embodiment, the two fixed pulleys 16*a* and 16*b* are used such that the counter weight 17 reaches its lowest point in the middle of the raising or lowering of the door body 13, assists the raising or lowering when starting the raising or lowering, and acts as a resistance against the raising or lowering before completing the raising or lowering. However, as long as the same operation can be achieved, only a single fixed pulley 16 may be used, as illustrated in FIGS. 6A and 6B. Alternatively, a drum 32 may be adopted instead of the fixed pulley 16 as illustrated in FIGS. 7A and 7B.

Furthermore, in the above embodiment, the floating inspection weight 24 and the operation inspection movable pulley 28 are hung on the same hanging member 13*b*.

However, they may be hung at different locations.

Moreover, the waterproof film 20 has no particular limitations regarding flexibility or other properties as long as it can seal the space between neighboring door bodies 13 in a watertight manner.

In accordance with the present invention, conformity to the water level can be improved when starting the raising or lowering, and also the impact of the raising or lowering can be mitigated before completing the raising or lowering. Additionally, a floating inspection on the start of raising can be performed merely by hanging a floating inspection weight on the back end surface of a target door body.

Furthermore, an operation inspection between a lowered state and a raised state can be performed merely by hanging the operation inspection movable pulleys, instead of floating inspection weights, on the back end surfaces of the door bodies, and winding the rope wound around both the movable pulleys and the operation inspection fixed pulleys using the winch.

Moreover, in accordance with the present invention, the counter weights and the fixed pulleys are installed below the back side of the door bodies, so that there are no components of the flap gate above the door bodies when the door bodies are in a lowered state, and thus the landscape is not spoiled by the flap gate.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A land-mounted flap gate, comprising:

a plurality of door bodies arranged and connected alongside one another, wherein the plurality of door bodies having a top side and a bottom side, wherein the plurality of door bodies being raised and lowered using the bottom side of each door as a support point;

a first rope having one end and a remaining end;

a counterweight;

at least one fixed pulley, and a waterproof film that seals a space between neighboring door bodies in a waterproof manner, wherein the one end of the first rope is attached to the bottom side of the door body and the remaining end of the first rope is attached to the counter weight, and the at least one fixed pulley for guiding the first rope is disposed below the bottom side of the door body such that the counter weight reaches its lowest point in a middle of raising or lowering of the door body, assists the raising or lowering when starting the raising or lowering, and acts as a resistance against the raising or lowering before completing the raising or lowering, and the waterproof film is formed in a substantially trapezoidal shape whose width extends gradually from a back end side of the door body to a front end side thereof.

2. The land-mounted flap gate of claim 1, further comprising:

a hanging member on which a floating inspection weight for checking a start of the raising is hung, wherein the hanging member is disposed on the bottom side of each of the door bodies.

3. The land-mounted flap gate of claim 1, further comprising:

a hanging member on which an operation inspection movable pulley for checking operations between a lowered state and a raised state is hung, an operation inspection fixed pulley for guiding a second rope wound around the operation inspection movable pulley hung on each door body, and a winch for winding the second rope, wherein the hanging member is disposed on the bottom side of each of the door bodies, and the operation inspection fixed pulley and the winch disposed below the bottom side of the door body.

* * * * *